US005322191A

United States Patent [19]

Johnson et al.

[11] Patent Number: 5,322,191

[45] Date of Patent: * Jun. 21, 1994

[54] LOW PRESSURE, HIGH VOLUME PRESSURIZED WATER GUN

[76] Inventors: Lonnie G. Johnson, 4030 Ridgehurst Dr., Smyrna, Ga. 30080; Bruce M. D'Andrade, 3 Ten Eyck Rd., Whitehouse Station, N.J. 08822

[ * ] Notice: The portion of the term of this patent subsequent to Sep. 29, 2009 has been disclaimed.

[21] Appl. No.: 902,078

[22] Filed: Jun. 22, 1992

Related U.S. Application Data

[63] Continuation-in-part of Ser. No. 841,762, Feb. 28, 1992, Pat. No. 5,150,819, which is a continuation of Ser. No. 680,247, Apr. 3, 1991, abandoned, which is a continuation-in-part of Ser. No. 578,145, Sep. 6, 1990, Pat. No. 5,074,437.

[51] Int. Cl.[5] ..... A63H 03/18

[52] U.S. Cl. ..... 222/79; 222/175; 222/401

[58] Field of Search ..... 222/79, 175, 400.7, 222/400.8, 130, 401, 325, 396; 239/597-601, 99, 333; 42/54; 446/473; 273/349; 124/70, 73

[56] References Cited

U.S. PATENT DOCUMENTS

| | | | |
|---|---|---|---|
| 2,589,977 | 3/1952 | Stelzer | 222/79 |
| 3,197,070 | 7/1965 | Pearl et al. . | |
| 3,509,584 | 5/1970 | Sable | 222/79 X |
| 3,578,789 | 5/1971 | Ferri . | |
| 4,214,674 | 7/1980 | Jones et al. . | |
| 4,239,129 | 12/1980 | Esposito . | |
| 4,401,271 | 8/1983 | Hansen | 239/599 X |
| 4,401,272 | 8/1983 | Merton et al. | 222/529 X |
| 4,615,488 | 10/1986 | Sands | 222/79 X |
| 4,735,239 | 4/1988 | Salmon et al. . | |
| 4,803,974 | 2/1989 | Powell | 222/79 X |
| 4,854,480 | 8/1989 | Shindo . | |
| 5,150,819 | 9/1992 | Johnson et al. | 222/401 X |
| 5,167,554 | 12/1992 | Tager et al. | 222/79 X |
| 5,184,755 | 2/1993 | Brovelli | 222/79 |
| 5,184,756 | 2/1993 | Amron | 222/401 X |

FOREIGN PATENT DOCUMENTS

| | | | |
|---|---|---|---|
| 634346 | 1/1962 | Canada | 239/599 |

*Primary Examiner*—Gregory L. Huson
*Attorney, Agent, or Firm*—Kenneth P. Glynn

[57] ABSTRACT

The present invention is a toy water gun having a housing with extending handle, a release mechanism and barrel. The water gun is connected to at least one water source external from and connected to the housing. In preferred embodiments, the water source is remote and has an indirect connection, e.g. by tubing or hosing, external of said housing and having a vent to surrounding ambient air so air may enter therethrough. Also included is a pressurized air and water storage tank external from and connectable to the housing. The pressurized tank has an orifice between said pressurized tank and said housing through which all liquids and gasses pass. There is also a pumping means for withdrawing air or water from the source or sources, and for depositing the withdrawn air or water into the pressurized tank. A plurality of one-way flow valves is included wherein at least one one-way flow valve prohibits water and air from flowing from the pressurized tank to the pumping means, at least one said one-way flow valve prohibits water and air from flowing from the pumping means to the source or sources of air and water. There is a nozzle with a wide orifice therethrough, which affixed to the end of said barrel and an avenue of release connecting the nozzle to the pressurized tank. There is also a controlling means for regulating the flow of water and air through the avenue of release, the controlling means being actuatable by a release mechanism.

25 Claims, 3 Drawing Sheets

LOW PRESSURE, HIGH VOLUME PRESSURIZED WATER GUN

REFERENCES TO RELATED CASES

This application is a continuation-in-part of copending U.S. application Ser. No. 07/841,762, filed on Feb. 28, 1992 by Bruce M. D'Andrade and Lonnie Johnson, for "Double Tank Pinch Trigger Pump Water Gun", now U.S. Pat. No. 5,150,819, which is a File Wrapper Continuation of U.S. patent application Ser. No. 07/680,247, filed on Apr. 3, 1991, now abandoned, having the same inventors and title, which is a continuation-in-part of previously copending U.S. patent application Ser. No. 07/578,145, filed on Sep. 6, 1990, having the same inventors, for "Pinch Trigger Pump Water Gun", now U.S. Pat. No. 5,074,437, issued on Dec. 24, 1991.

BACKGROUND OF THE INVENTION

1. Field of the Invention

The present invention is directed to a toy water squirt gun, and more particularly to such a toy water squirt gun that uses a self-contained pumping means to draw water from at least one water source, e.g. a remote source, to compress an air cushion with the drawn water, and store the water pressurized by the compressed air in at least one pressurized reservoir. The water is then released in a selective manner through a wide nozzle, causing the stored water to be propelled forward in a wide stream in large volumes.

2. Prior Art Statement

Water guns have for decades been a very popular child's toy. Since the toy industry is very competitive, hundreds of different style water guns have been developed in an attempt to profit from the toy's inherent popularity. The most traditional forms of water guns are activated by a pumping action, either manually through the trigger or automatically through a battery operated motor. Such pump action water guns work, but the guns are limited in the distance the water traveled, the amount of water projected and the duration of the pumping cycle. In an attempt to improve upon water guns, the toy industry has developed pressure activated water guns. Such pressure activated water guns work upon the principle of pressure differentials between the water held within the toy and the atmosphere. The water within the toy is subjected to a pressure higher than that of the ambient air. As a result, when the water within the toy is given an avenue of escape, the water will stream out under the pressure. Prior art that shows pressure differential types of water guns are exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured volume. Once the confined volume is fully collapsed, the re-expansion of the volume draws forth more water from a reservoir, thus priming the water gun for another cycle. The water being pressurized is limited to the volume of the collapsible volume. The Pearl '070 invention cannot store pressurized water for use at a later time, nor can the pressure of the water be increased by cycling the pumping action of the invention while restraining water discharge.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder.

Water guns have also been developed that use air pressure to pressurize water and force water through squirt channels. Such toys that use air pumps to pressurize water are exemplified by the following:

U.S. Pat. No. 4,214,674 to Jones et al, shows a two-piece apparatus consisting of a pressurized water reservoir and a discharging gun. Air is introduced into the water reservoir via a hand operated pump. The air pressurizes the water, forcing it up through the discharging gun, where the rate of discharge can be regulated by a trigger.

U.S. Pat. No. 4,239,129 to Gary F. Esposito describes a water pistol and/or flashlight structure which includes a reciprocal pump within the gun housing. The pump is used to pressurize air within the tank after water has been added, and a trigger is used for subsequent release of the water. Battery operated lights and sound are also provided.

U.S. Pat. No. 3,578,789, issued to Giampiero Ferri, describes a water pistol which includes a main liquid reservoir and a pressurized liquid reservoir contained within the main liquid reservoir. A trigger-actuated pump is used with a manually operated three way valve to selectively supply liquid: (a) from the pump to the pressurized reservoir; (b) from the pump to the nozzle and to the pressurized liquid reservoir; or, (c) from the pump to both the pressurized liquid reservoir and the nozzle. The Ferri water gun is limited in many ways as compared to the present invention. Ferri does not have a separate hand pump but relies only upon the trigger as a pump (limited to finger pumping). Ferri requires manual valve switching with complicated steps not easily performed by young children. Ferri has limited liquid capacity as the main liquid reservoir is inside the housing (handle) and is very limited in pressurized tank capacity as the Ferri pressurized tank is within the main liquid reservoir.

Thus, although prior art does show toy water guns that have collapsible water chambers and self-contained pumping means, the prior art neither teaches nor suggests a toy water gun that uses a self-contained, hand operated water pumping device to draw both water and air or either from at least one remote source, to pressurize air with the water drawn, and to store the pressurized air and water in at least one pressurized tank, where it can accumulate until discharged.

SUMMARY OF THE INVENTION

The present invention is a toy water gun having a housing with extending handle, a release means and barrel. The water gun has at least one water source external from and connected to the housing. In preferred embodiments, the water source is remote and has an indirect connection, e.g. by tubing or hosing, external of said housing and having a vent to surrounding ambient air so air may enter therethrough. Also included is a pressurized air and water storage tank external from and connected to the housing. The pressurized tank has an orifice between said pressurized tank and said housing through which all liquids and gasses pass. There is also a pumping means for withdrawing air or water from the source or sources, and for depositing the withdrawn air or water into the pressurized tank. A plurality of one-way flow valves is included wherein at least one one-way flow valve prohibits water and air from flowing from the pressurized tank to the pumping means, at least one said one-way flow valve prohibits water and air from flowing from the pumping means to the source or sources of air and water. There is a nozzle with a wide orifice therethrough, which affixed to the end of said barrel and an avenue of release connecting the nozzle to the pressurized tank. There is also a controlling means for regulating the flow of water and air through the avenue of release, the controlling means being actuatable by a release means.

BRIEF DESCRIPTION OF THE DRAWINGS

The invention will be more fully understood by referring to the following detailed specification, the above specification and the claims set forth herein, when taken in connection with the drawings appended hereto, wherein:

DETAILED DESCRIPTION OF THE PRESENT INVENTION

Figure 1:
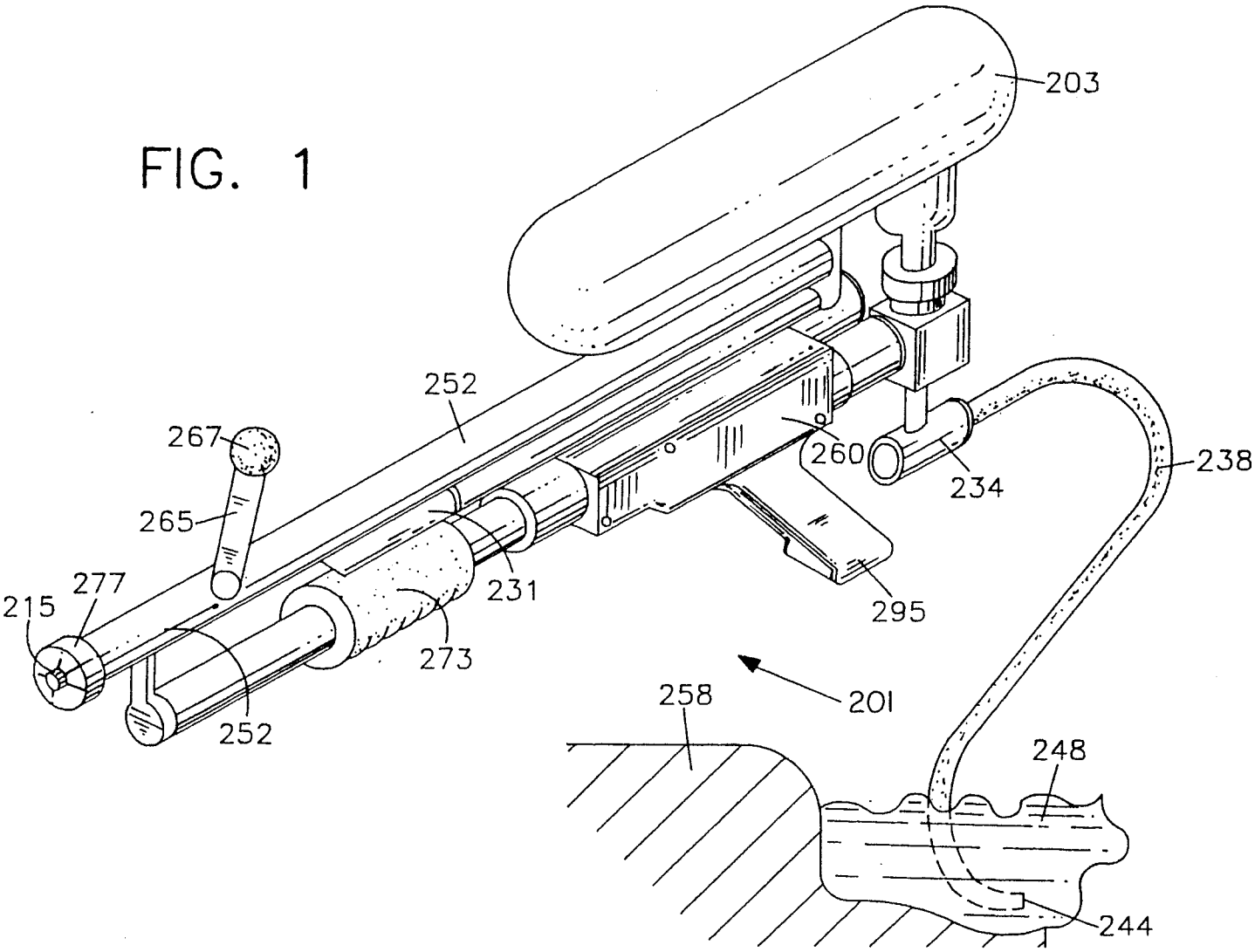
FIG. 1 shows a perspective view of one preferred embodiment of the present invention.

The present invention is, as mentioned, directed toward a toy water gun that uses a manually operated pump to draw water and/or air, and then pressurize the air at low pressures, e.g. 15 to 30 psig., to exert pressure on the water, and to store the water and air under pressure until selectively discharged. The science of pressurized water toys is not new, and over the years many different designs have been developed utilizing a pumping action to pressurize water. As applied to the art of toy water squirt guns, the most common type of device involves a two-stroke pump, wherein the pump draws water into a chamber through a large orifice during the priming stroke, and forces water out of the chamber through a very narrow orifice during the compression stroke. This simple system forms the basis of thousands of devices in addition to water guns, such as non-aerosol dispensing devices for hair spray, perfume, window cleaner, and countless other products that are dispensed in a narrow stream or mist.

The problem with simple two-stroke squirting systems is that the amount of liquid that can be expelled is limited to a single volume of the compressible area; also, the pressure of the liquid exiting the device is dependent directly upon the force being applied during the time of expulsion. Consequently, when water is squirted in this manner, only a small volume is released with each pumping action. When attempts are made to increase the amount of water propelled by increasing the volume of the compressible area, the pumping action cannot displace the water at a high pressure, resulting in expulsion of water at low pressures.

Water guns have advantageously involved squirting large volumes of water at high pressures. Generally, the higher the pressure, the longer the distance the water can be propelled, thus increasing the range and power of the water gun. The present invention water gun uses a two-stroke pump to store and pressurize large amounts of water, but relies upon low pressure and wide avenue of release and a wide nozzle to achieve squirts of large volumes of water which are generally non-turbulent squirts as they exit the nozzle. The present invention draws water from a water source, pumps the water into a closed pressure tank pressurizing the absent air in the tank, herein referred to as a "pressurized tank", where it remains under pressure of the air at the "top" of the tank. As more and more water and/or air are drawn, pressurized and deposited within the pressurized tank, the volume of water and the pressure on the stored water increases, compressing the air within the pressurized tank to a desired low pressure, e.g. 20 psig. The water propelled by the compressed air can then be selectively released through a wide orifice, creating a smooth or at least non-turbulent stream of propelled water. The pressurized tank system of the present invention allows the user of the invention to determine the volume and pressure of the water to be discharged up to the maximum available from the pump, and also allows a user to refill and replace the water from a water source without disabling the water gun's ability to discharge water. The pressurized tank system gives the water guns of the present invention a variety of firing characteristics that are unique in the art of toy water guns, allowing an operator some leeway in choosing and adjusting the range and power of the water gun. By having at least one pressurized tank, and possibly two or more of such pressurized tanks, substantial advantages are achieved, e.g. sufficient or increased storage for more shots and increased pressurized water for the ability to drench someone in a water gun battle.

The present invention also has other advantages over many other pressurized container water guns, in that, instead of pumping air into a chamber that already contains water, the present invention pumps water or air or water and air (hereinafter "water and/or air") into a chamber containing air. The pumping of water is more efficient than the pumping of air, thus less pumping strokes are required and higher pressures are easier to achieve.

The present invention is thus directed to a toy water gun which is operated by drawing water from a water source, e.g. a remote water source, and by selectively releasing water from at least one pressurized water tank. The present invention has a manually operated pump incorporated into the design. As the pump is cycled, water and/or air are drawn from at least one water source or the ambient atmosphere, respectively. Once drawn, the water and/or air are forced by the pump through conduits or passages in the housing into at least one pressurized tank. As the amount of water and/or air forced into the pressurized tank increases, the pressure of the air displaced by the water within the pressurized tank increases. The pressure of the air on the water within the pressurized tank increases with each cycle of the pump, until the pump can no longer overcome the pressure of the air on the water within the pressurized tank or until a present pressure is achieved after which a pressure release valve may present further pressure increases. In this invention, low pressures of about 10 to about 30 or so psig. is desired and allows for large slugs of water to be released from the water gun. With increased diameter avenues of release and low pressures, smooth flow is achieved.

The pressurized air and water within the pressurized tank has an avenue of release that is regulated by a release means. When the release means is in a first position, the pressurized water and air are held at bay with no means of release. When force is applied to the release means and it is moved to a second (open) portion, the heavier water is first released from the bottom of the pressurized tank and is channeled through a wide nozzle in laminar or near laminar flow. The wide nozzle is in excess of ⅛ inch, such as 3/16 inch, ¼ inch or even larger. The escape of the air pressurized water through the wide nozzle creates a continuous stream of propelled water that lasts as long as the release means is engaged or until the pressure within the pressurized tank equals the ambient air pressure.

Referring now to FIG. 1, one preferred embodiment of the present invention, water gun 201, is shown. FIG. 1 shows a perspective view of the present invention water gun 201 and a remote water source 248. Gun 201 includes pressurized tank 203 connected to main housing 260 which is shaped generally in the form of a gun having a handle 295, release means 265 and barrel 252. There is a slider handle 273 which surrounds barrel 252 and is slidable toward and away from handle 295. Slider handle 273 is connected to piston rod 231, which itself constitutes a portion of a pumping means for operation of toy gun 201. Outside conduit 238 has a connection section 234 which includes at least one one-way valve to prevent water and pressurized air from flowing outwardly down conduit 238. Outside conduit 238 has distal end 244 submerged in or otherwise in fluid communication with remote water source 248. In this illustration, the remote water source 248 is in the form of a pond with land 258, as shown. However, the water source remotely located from the present invention water guns otherwise may be lakes, swimming pools, tubs, spas, sinks, or any other open water source, whereby the extended outside conduit is merely submerged or dropped into the remote water source. Further, the present invention water gun could be used with or include an enclosed remote water source, such as one or more vats, large bottles or tanks or other container. These may be connected indirectly through coupling means (via the outside conduit) to the water gun or not connected directly to the enclosed water source by a coupling so long as there is a means of causing water to communicate between the enclosed water source and the water gun, such as a flexible conduit immersed in the water in the enclosed water source. Finally, in less preferred embodiments, the water source may be a container structure attached directly to the water gun housing.

Figure 2:
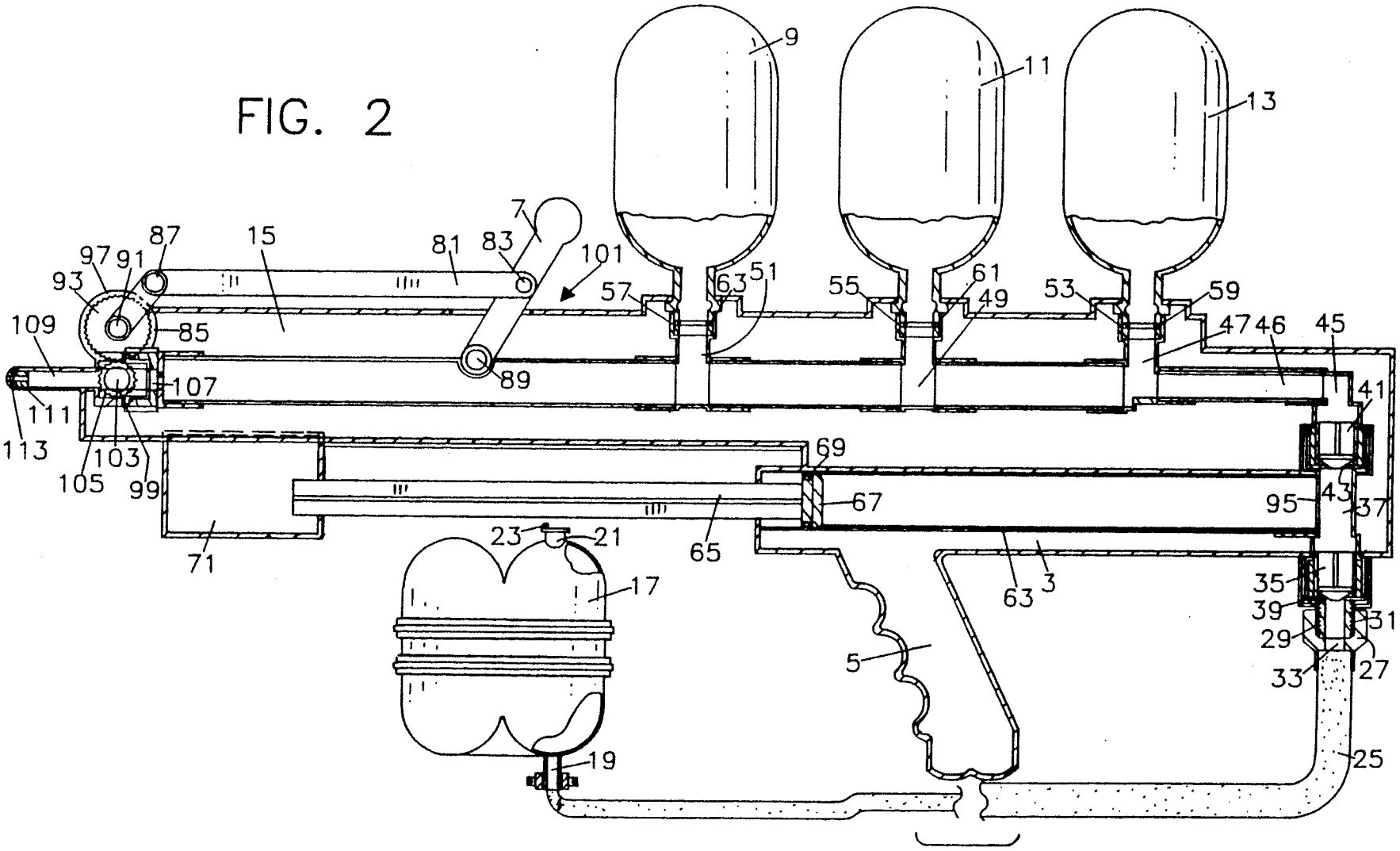
FIG. 2 shows a side cut view of an alternative embodiment present invention device; and, FIG. 3 shows a front cut section showing the pins, linkage and ball valve of the FIG. 2 embodiment.

The internal functioning and operational aspects of the toy water gun 201 shown in FIG. 1 are the same as for the toy water gun 101 shown in FIG. 2, except that gun 201 is connected to an open water source and gun 101 is indirectly attached to a closed water source. Nonetheless, the description below as to FIGS. 2 and 3 applies to all aspects of the FIG. 1 water gun 201 except for the water source arrangement and except that the release means and other components have different appearances.

Figure 3:
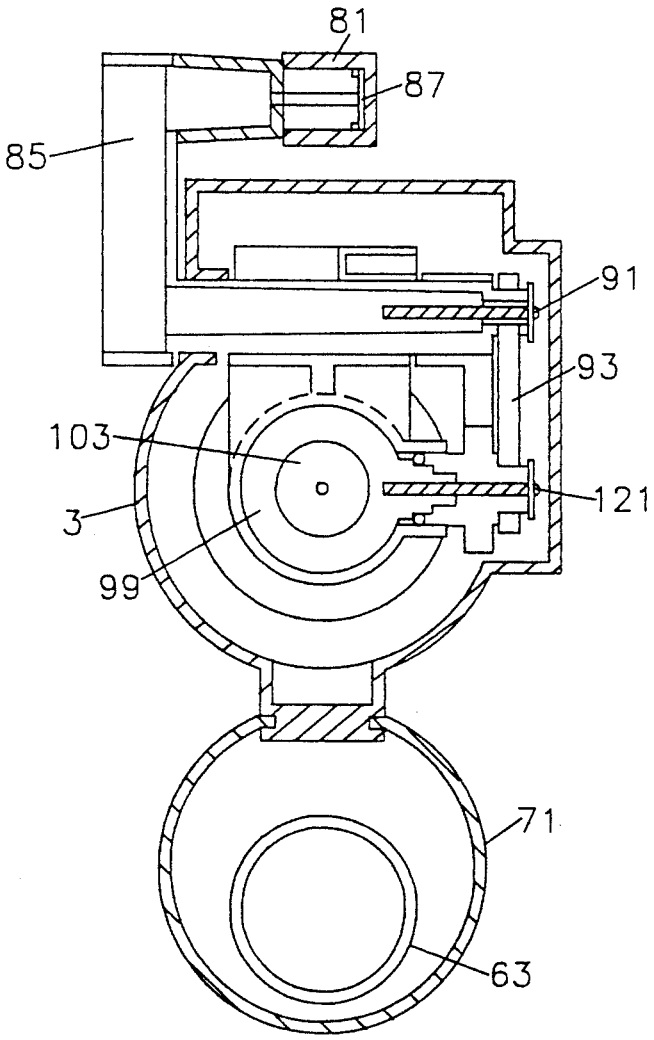

Referring now to FIGS. 2 and 3 together, there is shown a side cut view of water gun 101 in FIG. 2, and a front cut view in FIG. 3. The inner workings of present invention water guns can best be visualized and explained in discussing FIGS. 2 and 3. There is generally shown a housing 3, handle 5, release means 7 on housing 3, three pressurized tanks 9, 11 and 13, barrel 15 and storage reservoir 17.

Water is placed within water storage reservoir 17 and pumped into tanks 9, 11 and 13 which are pressurized for subsequent firing. The water is introduced by being poured through the filling port and cap assembly 21, with vent 23. Alternatively, filling port and cap assembly 83 could be eliminated and reservoir 38 could be filled through its neck, by removal of base outlet cap 19 and immersion in a water source.

The water storage reservoir 17 is shown in FIG. 2 as being somewhat double bottle shaped, with a neck having threads, as shown. However, it should also be understood that the storage reservoir 17 can be formed in any shape or size, as long as it is designed to hold and store water. It is generally of substantial value, e.g. larger than the combined volumes of pressurized tanks 9, 11 and 13, to allow for reloading without refilling. Optional support strappings (not shown) may be used as shoulder straps, a belt or clip attachment for wearing the reservoir 17. Thus, reservoir 17 may be clipped or strapped to a belt or back or leg or arm of a user, or otherwise attached to a user.

Water and air from air space within reservoir 17 are drawn from the reservoir 17 through outside conduit flexible tubing 25 which is connected to housing 3 via connector 27 which has threads 29, threaded to housing 3 at threads 31. The invention will draw either water or air or both from the storage reservoir 17, depending on the orientation of the reservoir and its content when the operator draws materials from the storage reservoir 17. As water and/or air are drawn from the storage reservoir 17, a partial vacuum is produced within reservoir 17. The vacuum is eliminated by a vent 23 located atop storage reservoir 17. Vent 23 may be a simple flap or even a small orifice, as long as air can enter the reservoir 17 and little or no water spills out.

The force drawing the water and/or air from the storage reservoir 17 is created by the movement of the piston 67 within its cylinder 68. The movement of the presently preferred piston 67 within the cylinder 68 has two-cycle strokes, a priming stroke where water is drawn forth from the water storage reservoir 17, and/or air is drawn from the water storage reservoir 17 or the ambient atmosphere through vent valve 23, and a compression stroke wherein water and/or air are displaced by the piston 67.

In one preferred embodiment, the priming stroke starts when the piston 67 is retreated within its cylinder 68 (i.e. pulled out toward the front or left side, in FIG. 2), creating an expanding volume cylinder 68. O-ring 69 acts as a piston seal. The vacuum created by the moving piston 67 draws water and/or air from reservoir 17 through the conduit 25 and connector orifice 33, past one-way valve 35, into inlet tubing 37, through opening 95 and into cylinder 68. The flow of water and/or air into the expanding cylinder 68 opens one-way valve 35 that is normally biased in a closed position in its seat 39.

The one-way valve 35 that is shown in FIG. 2 consists of a float that is biased against its seat 39 when pump handle 71 is moved inwardly to compression (pushed in) and valve 35 is pulled up from its seat 39 when pump handle 71 is moved outwardly (pulled out), allowing water and/or air to pass into the chamber of cylinder 68. As the piston 67 is advanced (pushed in) within its cylinder 68 (to the rear of the water gun or the right in FIG. 2), the compression stroke begins and pressure is placed on the water or air now within the chamber. The water or air is forced toward the end of the cylinder, closing the one-way valve 35 and opening the one-way valve 41 upwardly and away from its seat 43. Although float valves are illustrated, it should be understood that any type of a one-way valve would work within the present invention as long as the valve made a seal that is both airtight and watertight, e.g. a ball float or a flap valve.

The compression stroke created by the advancement of the piston 67 within the cylinder 68 (to the rear or the right in FIG. 2) causes pressure to be put on the water and/or air within the chamber of cylinder 68. The pressurized water and/or air, as a result of the diminishing volume of the compression stroke, water and/or air is moved through opening 95, into tubing 37 past valve 41, through elbow tube 45 and rigid straight tube 46, and with the release means 7 closed, up into tank connecting tubes 47, 49 and 51, through connectors 53, 55 and 57 and into the pressurized tanks 9, 11 and 13. O-ring seals 59, 61 and 63 inhibit leaking. As the piston 67 is reciprocated within its cylinder 68, water and/or air is repeatedly drawn through the outside conduit tubing 25 from the storage reservoir 17 (or, if tubing 25 were disconnected from reservoir 17 and dropped into open water, than from a remote source) and deposited into the pressurized tanks 9, 11 and 13. As more and more water and/or air is drawn and forced into the pressurized tanks 9, 11 and 13, the air pressure within these pressurized tanks increases until the force used to drive the piston 67 can no longer overcome the stored pressure, or until the pressure is released through an optional safety release valve (not shown). Generally, pressures of over 10 psig., e.g. 14 to 20 psig. are advantageous for this invention.

The movement of the piston 67 within cylinder 68 draws water and/or air from storage reservoir 17. However, when the storage reservoir 17 is positioned so that the air within the storage reservoir 17 is in contact with the outlet cap 19, the movement of the piston 67 will draw air into the pumping cylinder 68. When the pumping is compressed, the air will become pressurized and flow into the pressurized tanks 9, 11 and 13 increasing an air cushion in the air space in the pressurized tanks, while increasing the pressure on the water but not increasing the volume of any water present within the pressurized tanks. By having a pumping action that can introduce both air and water into the pressurized tanks, the pressure of the air can be increased above that available by relying upon existing air compression within the pressurized tanks and/or the addition of more air for compression. However, the pumping of water is more efficient than that of air because of the incompressibility of liquids. Therefore the work available from the pumping system is maximized when used to pump water against an air cushion.

The operation of the pumping action is achieved by the piston 67 being driven by a piston rod 65 that is affixed to a handle 71. The handle 71, as shown in this embodiment, is slidably attached to the barrel 15. As the handle 71 is manually reciprocated along the barrel 15, the motion is transferred to the piston 67, creating the desired pumping effect. Although a linear pumping action is shown, it should be understood that a variety of orientations and multiple linkage configurations could be manipulated by a user to create the desired pumping motion.

Once the desired pressure is obtained within the pressurized tanks 9, 11 and 13, the water under compressed air is discharged by selectively opening a release means 7, to the surrounding ambient air. The pressure differential between the ambient atmosphere and the air inside the pressurized tanks causes the water to stream out.

In the shown embodiment of the present invention, avenue of release 73 connects the pressurized tanks 9, 11 and 13 to the ambient air is a wide rigid tube, e.g. 1 inch diameter, which narrows e.g. to ½ inch, at constriction 107, passes through outlet 103 in valve ball 99 and through exit tube 109. Release means 7 has a first position (toward the tanks) which is closed, and a second position (opposite direction) which is open. Release means 7 is hingedly attached to housing 3 by pin 89, and is connected to linkage 81 at pin 83. Linkage 81 is connected to actuator arm 85 at its opposite end with pin. Actuator arm 85 is attached to and rotates with gear 93. Gear teeth 97 of gear 93 are interconnected with gear 105 attached to ball 99 with pin 121. Thus, referring again to both FIGS. 2 and 3, as release means 7 is opened, ball 99 rotates to open and air and /or water passes through valve outlet 103, to nozzle orifice 113 of nozzle 111. As water exits orifice 113, it does so in a slow, non-turbulent fashion due to the low pressure and the wide orifice 113, e.g. ¼ inch. Laminar or near laminar flow of large volumes of water are achieved and a soaking effect can be accomplished quickly and effectively.

The use of a ball valve for the controlling means is preferred, although a gate valve or other non-obtrusive valve (i.e. not interfere with the flow) could be used. Likewise, release means 7 need not be an actual lever but could be any known or designed but functional valve handle or actuator.

The amount of pressurized water being discharged through exit orifice 113 is controlled by the user in a variety of ways. A user can control the amount of water discharged by controlling the action of release means 7. If the release means 7 is opened and left in that position, the pressurized water will be discharged until the pressurized tanks are empty, or until the pressure of the compressed air in air spaces equal that of the ambient air. The user may choose to discharge the pressurized water selectively, opening the release means 7 for short periods of time, resulting in a plurality of shots being discharged before the pressurized tanks need to be refilled or repressurized. A user may also choose to vary the pressure and amount of water being discharged by selectively adding the air within pressurized tanks. The more water or air is added, the higher the low pressure and the farther and longer the invention may propel water. The use of two or more storage reservoirs, such as reservoir 17, may permit the user to carry at least twice the capacity of a single reservoir and thus longer operation before going back to refill. Likewise, removing tubing 25 from reservoir 17 and dropping into an open water source When this type of arrangement is used, an "infinite" supply of water is drawn from the remote source.

As mentioned, an optional pressure release mechanism may be employed and the predetermined maximum value for the release valve or other safety release mechanism may preferably be between about 15 pounds per square inch and about 30 pounds per square inch, e.g. at 20 pounds per square inch (gauge). Other predetermined pressures of higher or lower value, e.g. about 25 pounds per square inch, may be used depending upon the particular components and specific configuration of a particular embodiment.

The above Figures show only selected embodiments of the present invention, and although these Figures show preferred embodiments of the invention, it should be understood that the present invention can be practiced in many forms other than those shown. The basis of the present invention is the wide nozzle and low pressure to achieve smooth flow, high volume "shots" of water the use of attached, limit water supply or remote supply for large capacity (an almost unlimited supply of water where a pool, pond, lake, stream, etc, type of large volume water source is used), that uses a manual water pump and a series of one-way valves and tubes to draw ambient water from at least one water source, pumping said water into at least one pressurized tank, where it is pressurized against an air cushion, and discharge that water selectively to the ambient atmosphere. The illustrated embodiments shown in the Figures are designs for the present invention which are both efficient and inexpensive to manufacture. It should therefore be understood that in light of the appended claims, that the invention may be practiced other than as specifically described, and individual parts may be modified or connected in orientations other than those shown.

What is claimed is:

1. A low pressure, high volume pressurized toy water gun that shoots water at low pressure and high volume having a housing with extending handle and barrel, said water gun comprising:

(a) at least one water source external from, and connectable to said housing, and at least one conduit external of said housing for connecting said source to said housing;

(b) at least one pressurized air and water tank external from and connected to said housing, said pressurized tank having an orifice between said pressurized tank and said housing through which all liquids and gasses pass;

(c) a pumping means for withdrawing water from said water source, air, or a combination thereof, and for depositing said withdrawn air and/or water into said pressurized tank;

(d) a plurality of one-way flow valves, wherein at least one of said one-way flow valves prohibits water and air from flowing from said pressurized tank to said pumping means, and another of at least one of said one-way flow valves prohibits water and air from flowing from said pumping means to said water source;

(e) a nozzle having an orifice therethrough of a diameter in excess of one eighth inch, said nozzle being affixed to the end of said barrel;

(f) an avenue of release connecting said nozzle to said pressurized tank;

(g) a controlling means connected to said avenue of release for regulating the flow of water and air through said avenue of release; and, (h) a release means attached to said housing and said controlling means, said release means being manually actuable for opening and closing said control means.

2. The water gun of claim 1, wherein said pumping means is a reciprocatable piston within a cylinder, said pumping means having a priming stroke wherein said piston retreats within said cylinder, and a compression stroke wherein said piston advances within said cylinder.

3. The water gun of claim 2 wherein said piston is affixed to a rod, said rod terminating at a handle.

4. The water gun of claim 2 wherein said priming stroke of said pumping means draws air through a vent and/or water through said conduit from said water source into said cylinder, past at least two of said one-way flow valves.

5. The water gun of claim 4 wherein said compression stroke of said pumping means forces said withdrawn water and/or air into said pressurized tank.

6. The water gun of claim 3 wherein said handle is slidably affixed to said barrel.

7. The water gun of claim 1 wherein said water source is a remote water source.

8. The water gun of claim 7 wherein said remote water source is one or more body mountable storage tanks which include venting and are attached to said housing via flexible tubing conduit.

9. The water gun of claim 7 wherein said remote water source is an open pool of water.

10. The water gun of claim 1 wherein said controlling means for regulating flow of water through said avenue of release is a ball valve.

11. The water gun of claim 1 having at least two pressurized tanks.

12. The water gun of claim 7 wherein said remote water source is at least two refillable tanks.

13. A toy water gun having a housing with extending trigger and barrel, said water gun comprising:

(a) at least one outside conduit external of said housing for connecting said housing to a source of water;

(b) at least one pressurized air and water tank external from and connected to said housing, said pressurized tank having an orifice between said pressurized tank and said housing through which all liquids and gasses pass;

(c) at least one vent located on at least one part of said water gun and open to surrounding ambient air, said vent being in communication with said orifice so that air may enter into said pressurized tank;

(d) a pumping means for withdrawing water from a remote water source, air from said vent or a combination thereof, and for depositing said withdrawn air and/or water into said pressurized tank;

(e) a plurality of one-way flow valves, wherein at least one of said one-way flow valves prohibits water and air from flowing from said pressurized tank to said pumping means, at least one of said one-way flow valves prohibits water and air from flowing from said pumping means to a remote water source;

(f) a nozzle having an orifice therethrough of a diameter in excess of one eighth inch, said nozzle being affixed to the end of said barrel;

(g) an avenue of release connecting said nozzle to said pressurized tank;

(h) a controlling means connected to said avenue of release for regulating the flow of water and air through said avenue of release; and, (i) a release means attached to said housing and said controlling means, said means being manually actuable for opening and closing said control means.

14. The water gun of claim 13 wherein said pumping means is a reciprocatable piston within a cylinder, said pumping means having a priming stroke wherein said piston retreats within said cylinder, and a compression stroke wherein said piston advances within said cylinder.

15. The water gun of claim 14 wherein said piston is affixed to a rod, said rod terminating at a handle.

16. The water gun of claim 14 wherein said priming stroke of said pumping means draws air through said vent and/or water through said conduit from said water source into said cylinder, past at least two of said one-way flow valves.

17. The water gun of claim 14 wherein said compression stroke of said pumping means forces said withdrawn water and/or air into said pressurized tank.

18. The water gun of claim 15 wherein said handle is slidably affixed to said barrel.

19. The water gun of claim 13 wherein said water source is a remote water source.

20. The water gun of claim 19 wherein said remote water source is one or more body mountable storage tanks which include venting and are connectable to said housing via flexible tubing conduit.

21. The water gun of claim 19 wherein said remote water source is an open pool of water.

22. The water gun of claim 13 wherein said controlling means for regulating the flow of water through said avenue of release is a ball valve.

23. The water gun of claim 13 having at least two pressurized tanks.

24. The water gun of claim 19 wherein said remote source is at least two refillable tanks.

25. The water gun of claim 16 having at least two pressurized tanks.

* * * * *